US007667697B2

(12) United States Patent
Ha et al.

(10) Patent No.: US 7,667,697 B2
(45) Date of Patent: Feb. 23, 2010

(54) ORGANIC ELECTRO-LUMINESCENCE DISPLAY DEVICE AND METHOD OF DRIVING THE SAME

(75) Inventors: Won Kyu Ha, Gyeongsangbuk-do (KR); Hak Su Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 734 days.

(21) Appl. No.: 11/212,668

(22) Filed: Aug. 29, 2005

(65) Prior Publication Data

US 2006/0055632 A1 Mar. 16, 2006

(30) Foreign Application Priority Data

Aug. 30, 2004 (KR) ..... 10-2004-0068460

(51) Int. Cl.
*G09G 5/00* (2006.01)

(52) U.S. Cl. ..... 345/215; 345/76

(58) Field of Classification Search ..... 345/76–78, 345/204, 214, 215; 250/553
See application file for complete search history.

(56) References Cited

U.S. PATENT DOCUMENTS

| | | | | |
|---|---|---|---|---|
| 6,563,478 | B2 * | 5/2003 | Aoki | 345/58 |
| 6,989,826 | B2 * | 1/2006 | Kasai | 345/204 |
| 7,034,781 | B2 * | 4/2006 | Irmer et al. | 345/76 |
| 7,106,281 | B2 * | 9/2006 | Kim et al. | 345/76 |
| 7,212,195 | B2 * | 5/2007 | Kawasaki | 345/204 |
| 7,292,234 | B2 * | 11/2007 | Kitahara | 345/204 |
| 7,400,098 | B2 * | 7/2008 | Ng et al. | 315/169.3 |
| 2004/0032381 | A1 * | 2/2004 | Chung et al. | 345/76 |
| 2004/0222950 | A1 * | 11/2004 | Kimura | 345/76 |
| 2004/0227749 | A1 | 11/2004 | Kimura | |
| 2005/0140596 | A1 * | 6/2005 | Lee et al. | 345/76 |

FOREIGN PATENT DOCUMENTS

| | | | |
|---|---|---|---|
| JP | 2001-296837 | A | 10/2001 |
| KR | 20030024403 | A | 3/2003 |
| KR | 10-2004-0026362 | A | 3/2004 |
| WO | WO-03/023752 | A1 | 3/2003 |
| WO | WO-2004/051615 | A1 | 6/2004 |

* cited by examiner

*Primary Examiner*—Richard Hjerpe
*Assistant Examiner*—Tom V Sheng
(74) *Attorney, Agent, or Firm*—Birch, Stewart, Kolasch & Birch, LLP

(57) ABSTRACT

The present invention relates to an organic electro-luminescence display device and a method of driving the same that is adaptive for reducing power consumption by removing an unnecessary current as well as for improving a uniformity of a display screen. An organic electro-luminescence display device according to an embodiment of the present invention includes: a display panel in which a plurality of data lines and a plurality of scan lines cross each other and electro-luminescence elements are arranged at the crosses; a pre-charge driver, which detects a gray level of digital video data to be realized at a Nth when a data current corresponding to a gray level of digital video data to be realized at a (N−1)th and calculates a pre-charge current corresponding to the detected gray level of digital video data to supply the calculated pre-charge current to the electro-luminescence elements; a data driver for supplying data to the electro-luminescence elements charged with the pre-charge current; and a scan driver for supplying a san pulse, synchronized with the data, to the scan lines.

4 Claims, 7 Drawing Sheets

ORGANIC ELECTRO-LUMINESCENCE DISPLAY DEVICE AND METHOD OF DRIVING THE SAME

This application claims the benefit of Korean Patent Application No. P2004-68460 filed in Korea on Aug. 30, 2004, which is hereby incorporated by reference.

BACKGROUND OF THE INVENTION

1. Field of the Invention

The present invention relates to an organic electro-luminescence display device, and more particularly, to an organic electro-luminescence display device and a method of driving the same that is adaptive for reducing power consumption by removing an unnecessary current as well as for improving a uniformity of a display screen.

2. Description of the Related Art

In recently, there has been developed various flat panel displays with a reduced weight and bulk that are free from the disadvantage of a cathode ray tube CRT. Such flat panel displays include a liquid crystal display LCD, a field emission display FED, a plasma display panel PDP, and an electro-luminescence (hereinafter, referred to as an EL) display devices.

The structure and fabricating process of the PDP among these is relatively simple. Thus, the PDP is most advantageous to be made large-sized, but has disadvantages that the light emission efficiency and brightness thereof are low and its power consumption is high.

The LCD is used as a display device of a notebook computer, the demand for it is gradually increased. However, the LCD is difficult to be made large-sized because of using a semiconductor process, and the LCD requires a separate light source because it is not a self-luminous device. Accordingly, the LCD has a disadvantage that the power consumption is high due to the separate light source. Further, the LCD has a disadvantage that there is a high optical loss caused by optical devices such as a polarizing filter, a prism sheet and a diffusion panel, and its viewing angle is narrow.

The EL display device is generally classified into an inorganic EL display device and an organic EL display device. The EL display device has an advantage that its response speed is fast, its light-emission efficiency and brightness are high, and it has wide viewing angle. The organic EL display device can display a picture in a high brightness of several ten thousands [cd/m $^2$] with a voltage of about 10[V] and has been applied to most of EL display devices, which are commonly used.

In a unit element of an organic EL display device, as shown in FIG. 1, an anode 2 is formed of a transparent conductive material on a substrate 1; and a hole injection layer 3, a light-emitting layer 4 made of an organic material and a cathode 15 made of a metal having a low work function are disposed thereon. If an electric field is applied between the anode 2 and the cathode 5, then holes within the hole injection layer 3 and electrons within the metal are progressed into the light-emitting layer 4 to combine each other in the light-emitting layer 4. Then, a phosphorous material within the light-emitting layer 4 is excited and transited to thereby generate a visible light. In this case, the brightness is in proportion to a current between the anode 2 and the cathode 5.

Such an organic EL display device is classified into a passive type and an active type.

FIG. 2 is a circuit diagram showing equivalently a portion of the passive type organic EL display device, and FIG. 3 is a waveform diagram showing waveforms of a scan signal and a data signal in the passive type organic EL display device.

Referring to FIGS. 2 and 3, the passive type EL display device includes an organic EL elements OLED arranged at intersections between both a plurality data lines D1 to D3 and a plurality of scan lines S1 to S3, which cross each other, and both a plurality data lines D1 to D3 and a plurality of scan lines S1 to S3, which cross each other.

The data lines D1 to D3 are connected to an anode of the organic EL element OLED to supply a data current Id to the anode of the organic EL element OLED.

The scan lines S1 to S3 are connected to a cathode of the organic EL element OLED to supply scan pulses SP1 to SP3, synchronized with the data current Id, to the cathode of the organic EL element OLED.

The organic EL elements OLED emit light in proportion to a current flowing between the anode 2 and cathode 5 during a display period DT when the scan pulses SP1 to SP3 are applied thereto. The organic EL elements OLED are charged with current during a response time RT delayed by a resistance component of the data lines D1 to D3 and a capacitance existed in the organic EL elements OLED, so that there is a problem of a low response speed and a low brightness. In order to compensate a low response speed of the organic EL elements OLED, it is on a trend that a pre-charge period PCHA is provide in non-display periods DCHA and PCHA between the display period DT and the display period DT as shown in FIG. 4 and the organic EL devices OLED are pre-charged during the pre-charge period PCHA.

However, in the related art pre-charge drive method, a maximum data current is supplied during the pre-charge period PCHA irrespective of gray level value of data applied to the organic EL elements OLED via the data lines D1 to D3 during the display period DT, and then a data current correspondence to the data gray level value is supplied to the organic EL elements OLED during the display period DT. Accordingly, if a data current of low gray level is supplied via the data lines D1 to D3 to the organic EL elements OLED during the display period DT, then an overshoot is generated and a response time of the organic EL elements OLED is delayed. In addition, the organic EL elements OLED are over-charged due to an unnecessary current supplied to the organic EL elements OLED via the data lines D1 to D3 during the pre-charge period PCHA in the low gray level. Accordingly, there is a problem that power consumption is increased in the organic EL display device.

SUMMARY OF THE INVENTION

Accordingly, it is an object of the present invention to provide an organic electro-luminescence display device and a method of driving the same that is adaptive for reducing power consumption by removing an unnecessary current as well as for improving a uniformity of a display screen.

In order to achieve these and other objects of the invention, an organic electro-luminescence display device according to an embodiment of the present invention includes: a display panel in which a plurality of data lines and a plurality of scan lines cross each other and electro-luminescence elements are arranged at the crosses; a pre-charge driver, which detects a gray level of digital video data to be realized at a Nth when a data current corresponding to a gray level of digital video data to be realized at a (N−1)th and calculates a pre-charge current corresponding to the detected gray level of digital video data to supply the calculated pre-charge current to the electro-luminescence elements; a data driver for supplying data to the electro-luminescence elements charged with the pre-charge current; and a scan driver for supplying a san pulse, synchronized with the data, to the scan lines.

The pre-charge driver supplies a pre-charge current, having levels different from each other in accordance with the gray level of the digital video data, to the organic electro-luminescence elements.

The pre-charge driver includes: a data converter for converting the gray level of the digital video data to be realized into an analog current; and a pre-charge current calculator for calculating the pre-charge current corresponding to the analog current converted in the data converter.

The pre-charge current is a value as a result from multiplying a current of data to be realized by a maximum value of the pre-charge current and then dividing it by a maximum value of the data current.

A method of driving an organic electro-luminescence display device, in which a plurality of data lines and a plurality of scan lines cross each other and electro-luminescence elements are arranged at the crosses, according to an embodiment of the present invention includes: detecting a gray level of digital video data to be realized at a Nth when a (N−1)th data current is discharged; converting the gray level of the detected digital video data into an analog current of a level corresponding to the gray level of the detected digital video data; calculating a pre-charge current by using the converted analog current; supplying the calculated pre-charge current via the data lines to the electro-luminescence elements; and supplying data to the electro-luminescence elements charged with the pre-charge current.

Calculating the pre-charge current includes multiplying the converted analog current by a maximum value of the pre-charge current and then dividing it by a maximum value of the data current.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 5 to 7.

Figure 1:
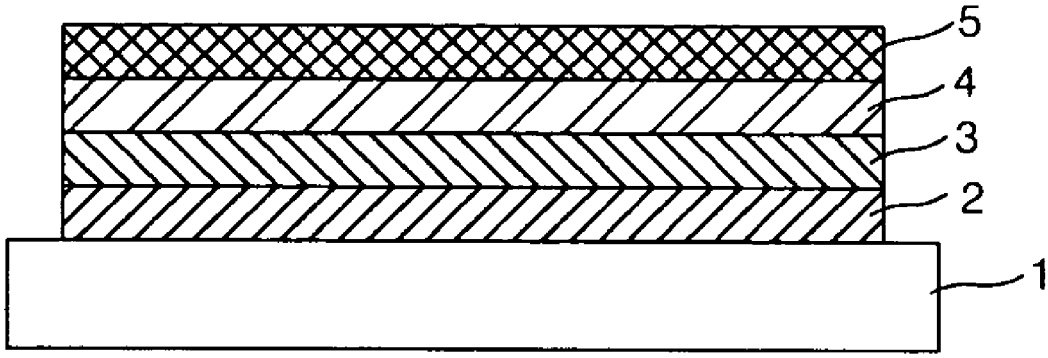
FIG. 1 RELATED ART
FIG. 1 is a schematic section view illustrating a unit element of a related art organic electro-luminescence display device.
Figure 2:
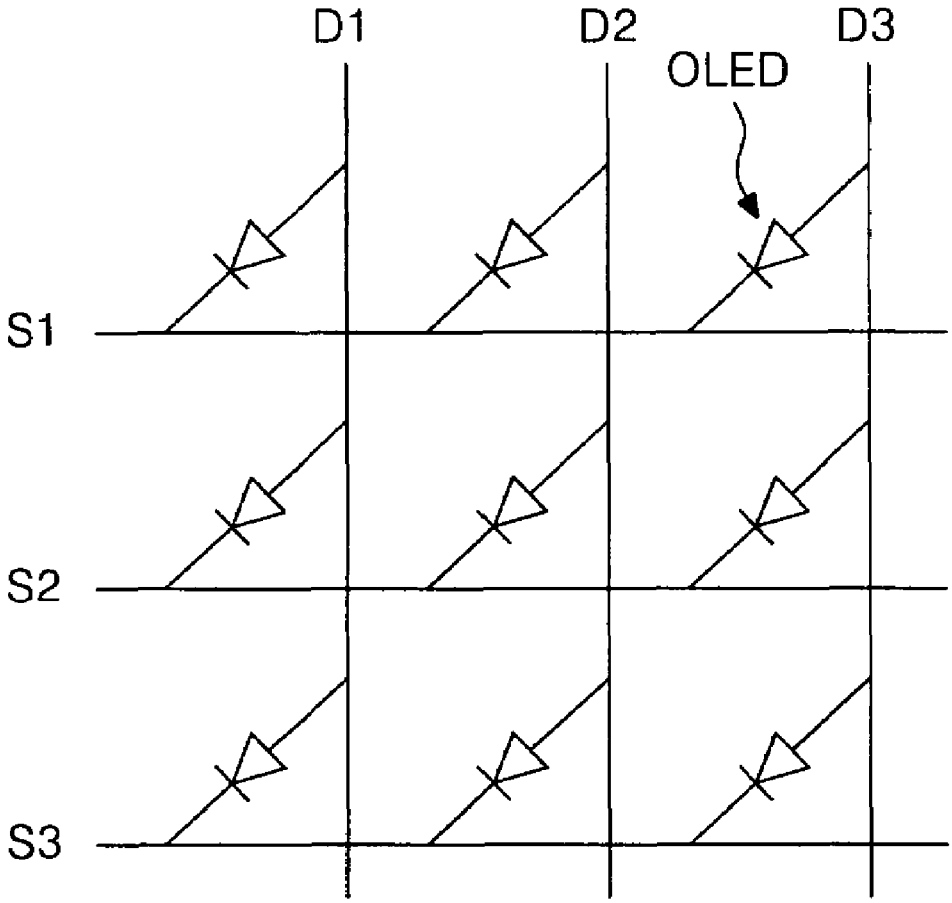
FIG. 2 RELATED ART
FIG. 2 is a circuit diagram showing equivalently a portion of the passive type organic EL display device.
Figure 3:
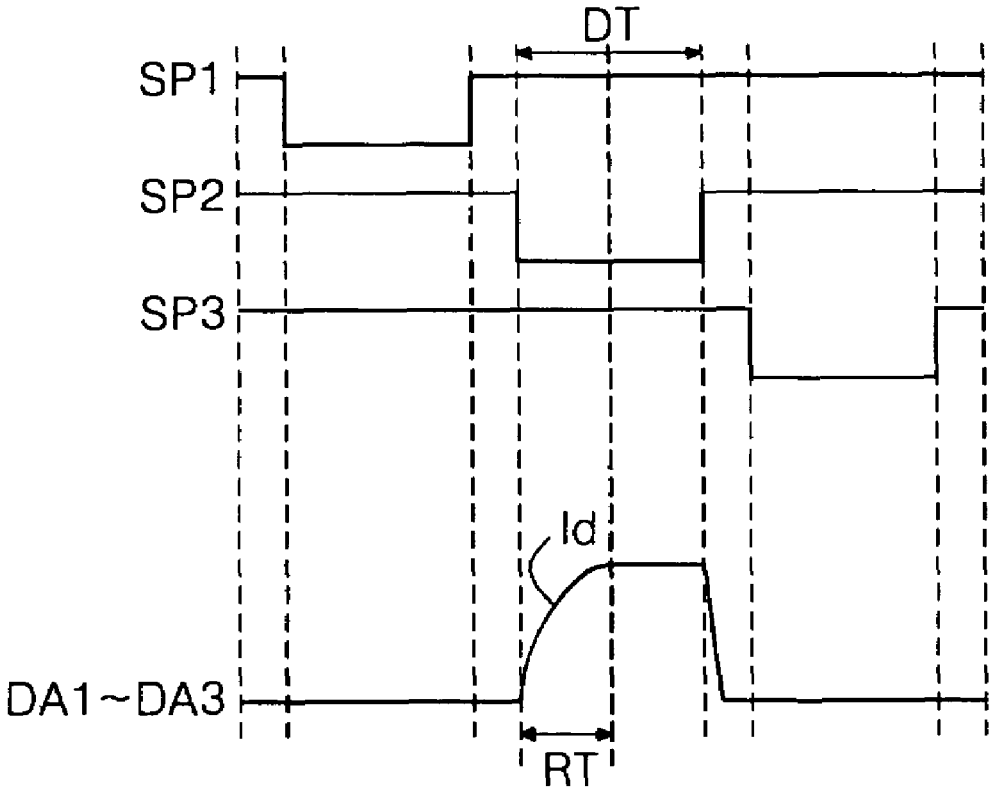
FIG. 3 RELATED ART
FIG. 3 is a waveform diagram showing a delay of a response time generated in the driving method of the related art organic EL display device.
Figure 4:
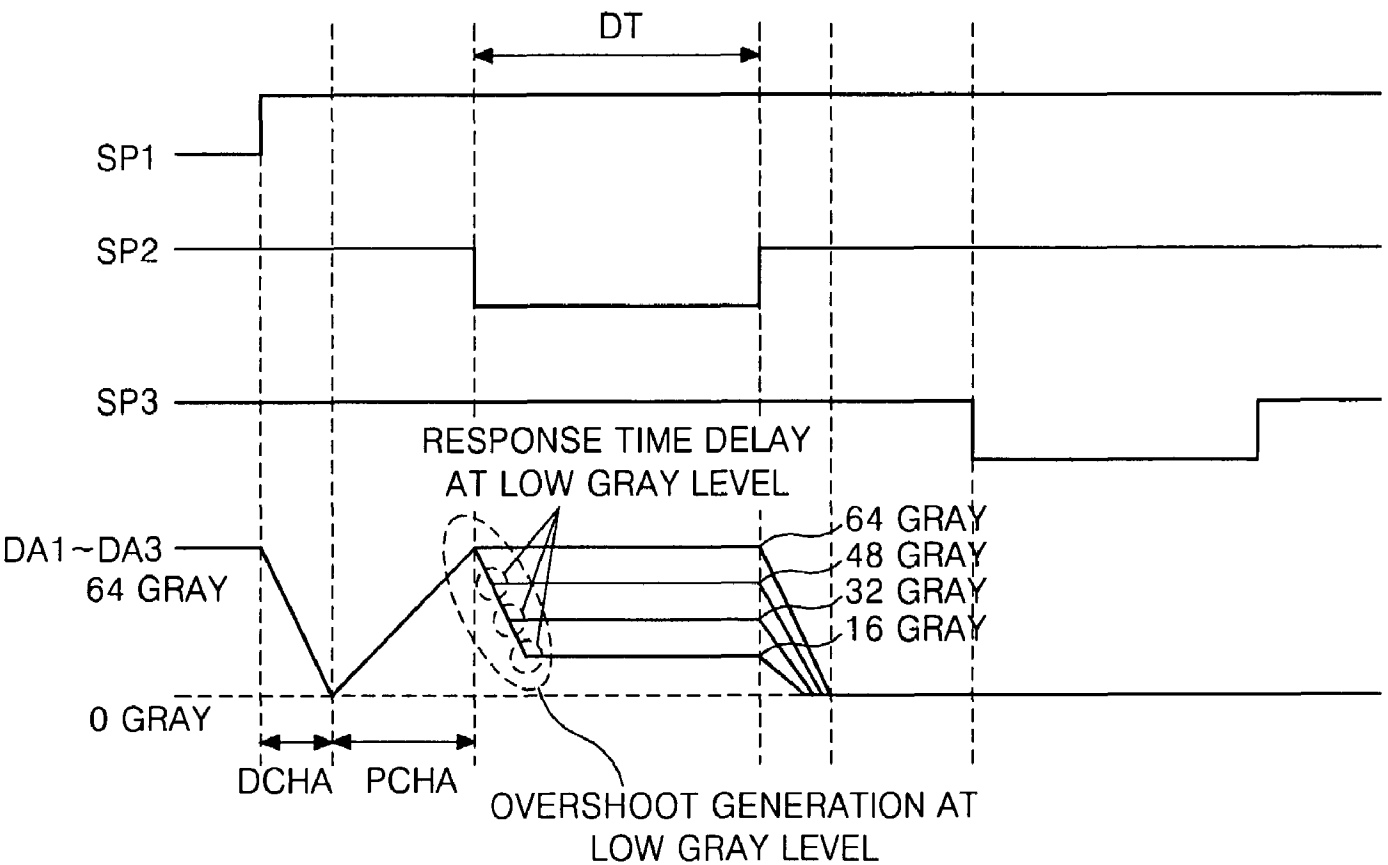
FIG. 4 RELATED ART
FIG. 4 is a waveform showing a related art pre-charge drive method.
Figure 5:
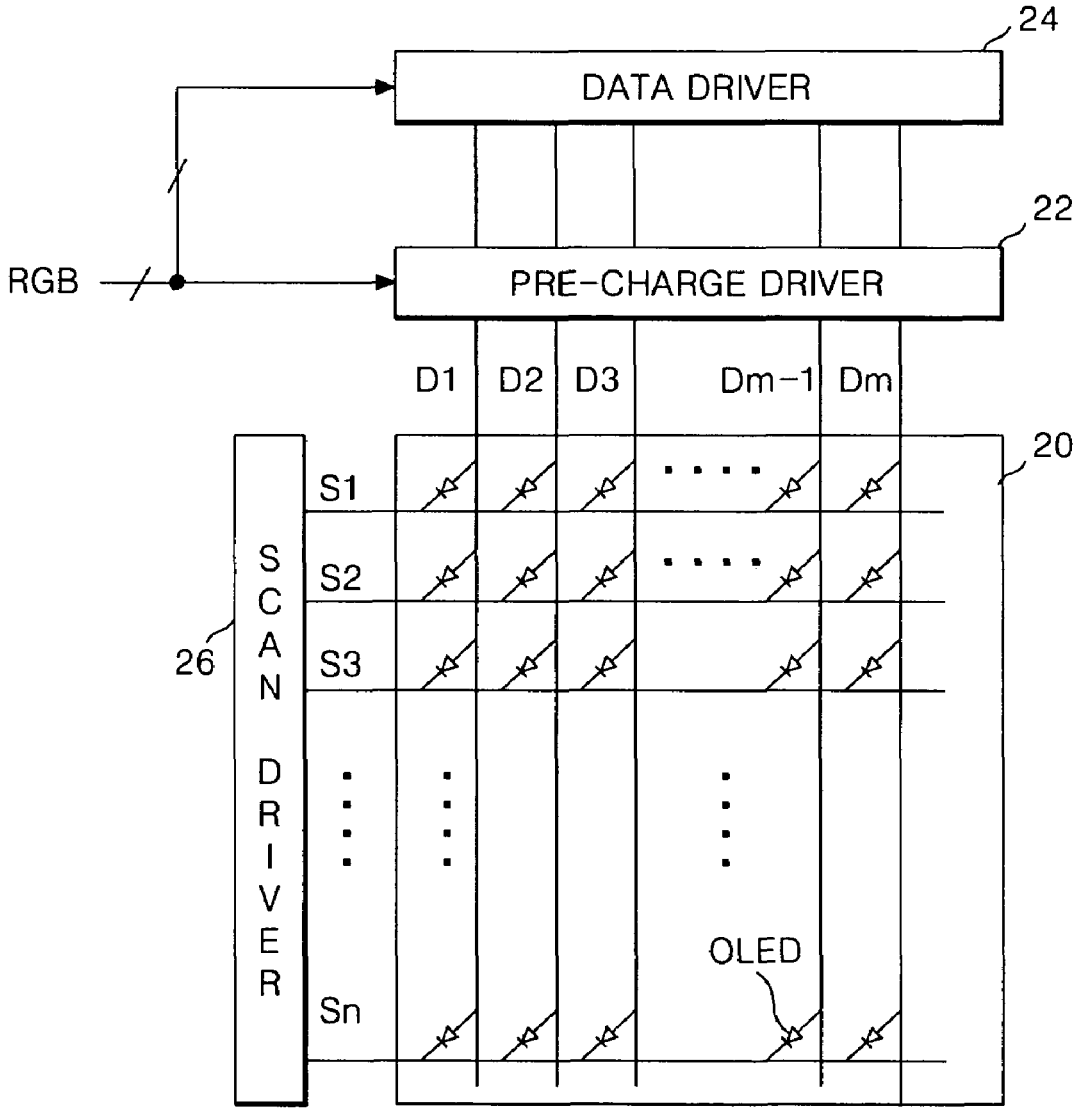
FIG. 5 is a diagram showing an organic electro-luminescence display device according to an embodiment of the present invention.
Figure 6:
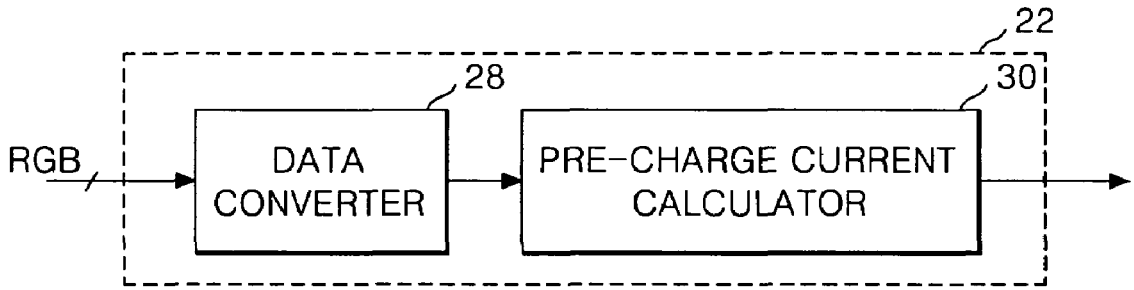
FIG. 6 is a diagram showing a pre-charge driver in FIG. 5.

FIG. 5 is a diagram showing an organic electro-luminescence (EL) display device according to an embodiment of the present invention.

Referring to FIG. 5, the organic EL display device according to the embodiment of the present invention includes: a display panel 20 in which a m×n number of organic EL elements OLED are arranged in a matrix type; a data driver 24 for generating a data current; a scan driver 26 for generating a scan pulse synchronized with the data current; and a pre-charge driver 22 for calculating a pre-charge current in accordance with a gray level of digital video data R, G and B to supply the calculated pre-charge current to the organic EL elements OLED.

In the display panel 20, a m number of data lines D1 to Dm and a n number of scan lines S1 to Sn cross each other, and the organic EL elements OLED are arranged between the crosses.

The data driver 24 includes a shift register circuit for sequentially sampling data, and a current source such as current mirror circuit or current sync circuit. Such a data driver 24 samples the digital video data R, G and B and then supplies a data current correspondence to a gray level value of the digital video data R, G, and B via the pre-charge driver 22 to the data lines D1 to Dm.

The scan driver 26 includes a shift register circuit for sequentially shifting a scan pulse to sequentially supply the scan pulse synchronizes with the data current to the scan lines S1 to Sn.

The pre-charge driver 22 detects a gray level of data to be realized at a (N−1)th, that is, a gray level of data to be realized at a Nth when a data current corresponding to a gray level of data is discharged, and calculates a pre-charge current in accordance with the gray level of the detected data to supply it via the data lines D1 to Dm to the organic EL elements OLED during a pre-charge period. Further, the pre-charge driver 22 supplies the data current applied from the data driver 24 to the data lines D1 to Dm during the display period. In this regard, the pre-charge driver 22, as shown in FIG. 6, includes: a data converter 28 for converting digital video data R, G and B into an analog current; and a pre-charge current calculator 30 for calculating a pre-charge current in accordance with the analog current converted in the data converter 28.

Figure 7:
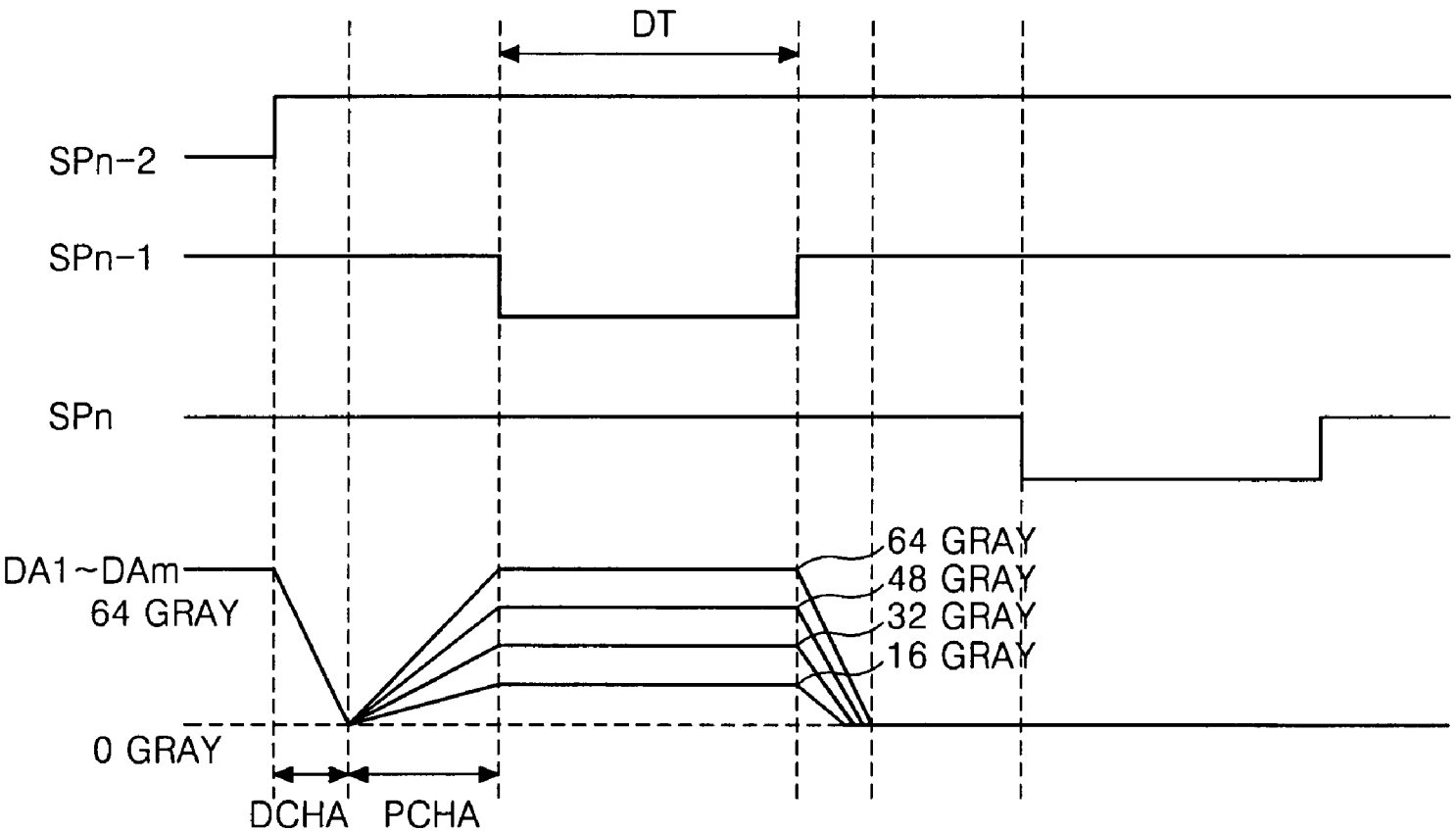
FIG. 7 is a waveform showing a driving method of the organic electro-luminescence display device according to the embodiment of the present invention.

The data converter 28, as shown in FIG. 7, detects a gray level value of digital video data R, G and B to be realized at a Nth during a discharge period DCHA when a data current corresponding to a gray level of data to be realized by a (N−1)th scan pulse SPn−1 at a (N−1)th is discharged, and then converts the detected gray level value of digital video data R, G and B into an analog current. For instance, in a case that a maximum gray level value of digital video data R, G and B is 64 gray and a maximum data current is 64 μA, the data converter 28 converts a gray level value of the detected digital video data R, G and B into an analog current having any one level in a range of 1 μA to 64 μA.

When the pre-charge current calculator 30 is supplied with the analog current value from the data converter 28, it calculates a pre-charge current by using Formula 1 and then supplies the pre-charge current to the organic EL elements OLED during the pre-charge period PCHA. For instance, if a maximum pre-charge current is 256 μA and a gray level value of digital video data R, G and B to be realized at a Nth is 32 gray, then the analog current value supplied from the data converter 28 to the pre-charge current calculator 30 is 32 μA. Thus, the pre-charge current calculator 30 supplies the pre-charge current of 128 μA calculated by Formula 1 via the data lines D1 to Dm to the organic EL elements OLED during the pre-charge period PCHA. In this case, a maximum value of the pre-charge current supplied from the pre-charge current calculator 30 has the same dimension as the data current supplied to the data lines D1 to Dm by a Nth scan pulse SPn in a Nth display period DT. Such a pre-charge current calculator 30 supplies a pre-charge current of levels different from each other in accordance with the analog current value supplied from the data converter 28 to the organic EL elements OLED.

$$\text{pre-charge current} = \frac{\text{maximum pre-charge current} \times \text{data curretn to be realized}}{\text{maximum data current}} \quad \text{[Formula 1]}$$

In the organic EL display device and the method of driving the same according to the embodiment of the present invention, the gray level value of the Nth digital video data R, G and B is detected in the discharge period DCHA when the data current corresponding to the gray level value of the (N−1)th digital video data R, G and B is discharge and then the pre-charge current corresponding to the gray level value of the Nth digital video data R, G and B is supplied to the organic EL elements OLED. Accordingly, since an unnecessary current is not flowed at a low gray level, it is possible to reduce power consumption of the organic EL display device. In addition, since an overshoot is prevented, it is possible to prevent an over-charge and a response time delay of the organic EL elements OLED. Thus, it is possible to improve a uniformity of the same gray expression on the same scan lines S1 to Sn of the display panel 20.

Meanwhile, the organic EL display device and the method of driving the same according to the embodiment of the present invention is described in a basis of the passive type, but it is applicable to well-known any active type organic electro-luminescence display devices.

As described above, in the organic EL display device and the method of driving the same according to the embodiment of the present invention, the gray level value of the Nth digital video data is detected in the discharge period DCHA when the data current corresponding to the gray level value of the (N−1)th digital video data is discharge and then the pre-charge current corresponding to the gray level value of the Nth digital video data is supplied to the organic EL elements. Accordingly, since an unnecessary current is not flowed at a low gray level, it is possible to reduce power consumption of the organic EL display device. In addition, since an overshoot is prevented, it is possible to prevent an over-charge and a response time delay of the organic EL elements. Thus, it is possible to improve a uniformity of the same gray expression on the same scan lines of the display panel.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An organic electro-luminescence display device comprising:

a display panel in which a plurality of data lines and a plurality of scan lines cross each other and electro-luminescence elements are arranged at the crosses;

a pre-charge driver, which detects a gray level of digital video data to be realized at a Nth display period when a data current corresponding to a gray level of digital video data to be realized at a (N−1)th display period and calculates a pre-charge current corresponding to the detected gray level of digital video data to supply the calculated pre-charge current to the electro-luminescence elements;

a data driver for supplying data to the electro-luminescence elements charged with the pre-charge current; and a scan driver for supplying a scan pulse, synchronized with the data, to the scan lines, wherein the pre-charge current is a value as a result from multiplying a current of data to be realized by a maximum value of the pre-charge current and then dividing it by a maximum value of the data current.

2. The organic electro-luminescence display device according to claim 1, wherein the pre-charge driver supplies a pre-charge current, having levels different from each other in accordance with the gray level of the digital video data, to die organic electro-luminescence elements.

3. The organic electro-luminescence display device according to claim 1, wherein the pre-charge driver includes:

a data converter for convening the gray level of the digital video data to be realized into an analog current; and a pre-charge current calculator for calculating the procharge current corresponding to the analog current converted in the data converter.

4. A method of driving an organic electro-luminescence display device, in which a plurality of data lines and a plurality of scan lines cross each other and electro-luminescence elements are arranged at the crosses, comprising:

detecting a gray level of digital video data to be realized at a Nth display period when a (N−1)th display period data current is discharged;

converting the gray level of the detected digital video data into an analog current of a level corresponding to the gray level of the detected digital video data;

calculating at pre-charge current by using the converted analog currant;

supplying the calculated pre-charge current via the data lines to the electro-luminescence elements; and supplying data to the electro-luminescence elements charged with the pre-charge current, wherein calculating the pre-charge current includes multiplying the converted analog current by a maximum value of the pre-charge current and then dividing it by a maximum value of the data current.

* * * * *